US005377988A

United States Patent [19]

Westman et al.

[11] Patent Number: 5,377,988

[45] Date of Patent: Jan. 3, 1995

[54] GOLF BALL PRACTICE DEVICE

[76] Inventors: Jim Westman; Torbjorn Westman, both of #607, 75 John Street, Waterdown, Ontario, Canada, L0R 2H0

[21] Appl. No.: 164,672

[22] Filed: Dec. 10, 1993

[51] Int. Cl.[6] ..... A63B 69/36

[52] U.S. Cl. ..... 273/199 A

[58] Field of Search ..... 273/199 R, 199 A, 187.3, 273/208; D21/204, 205, 208, 209

[56] References Cited

U.S. PATENT DOCUMENTS

| | | | |
|---|---|---|---|
| D. 31,878 | 11/1899 | Sewall | D21/208 |
| 300,335 | 3/1989 | Colclasure | D21/205 |
| 2,141,250 | 2/1937 | Perrault | 273/35 |
| 2,432,209 | 10/1945 | Osgood | 273/87 |
| 3,198,526 | 4/1963 | Smith et al. | 273/199 |
| 3,437,340 | 5/1967 | Grise' | 273/183 |
| 3,697,081 | 10/1972 | Peyroux | 273/199 A |
| 3,721,447 | 3/1973 | Louderback | 273/208 X |
| 4,088,319 | 5/1978 | Clarke | 273/58 R |
| 4,177,995 | 12/1979 | Surland | 273/199 A |
| 4,776,596 | 11/1988 | Nojima | 273/199 A |
| 5,228,696 | 7/1993 | Gianferrara | 273/199 A |

FOREIGN PATENT DOCUMENTS

| | | | |
|---|---|---|---|
| 1495597 | 9/1967 | France | 273/199 A |
| 16231 | of 1911 | United Kingdom | 273/200 R |
| 356890 | 9/1931 | United Kingdom | 273/199 R |
| 2173114 | 10/1986 | United Kingdom | 273/199 A |
| 91/06346 | 5/1991 | WIPO | 273/199 A |

*Primary Examiner*—George J. Marlo
*Attorney, Agent, or Firm*—Nixon & Vanderhye

[57] ABSTRACT

A golf practice device simulates the appearance and general flight characteristics of an actual regulation golf ball, but commonly only travels about 30–80 feet when impacted by a swung golf club. The device includes a substantially regulation ball connected by a shaft extending diametrically with respect to the ball to a substantially disc-shaped drag element, the disc perpendicular to the shaft and preferably of a one-piece molding of rubber or resilient plastic. The disc has a substantially flat bottom, and the disc and shaft act like a tee, allowing the ball to be "teed up" off any surface. The shaft may be ultrasonically welded to the exteriorly dimpled plastic shell of a regulation golf ball, the shaft extending through a diametrically extending opening in the ball; or the ball, shaft and disc may be unitarily molded of the same plastic material.

20 Claims, 3 Drawing Sheets

FIG. 3
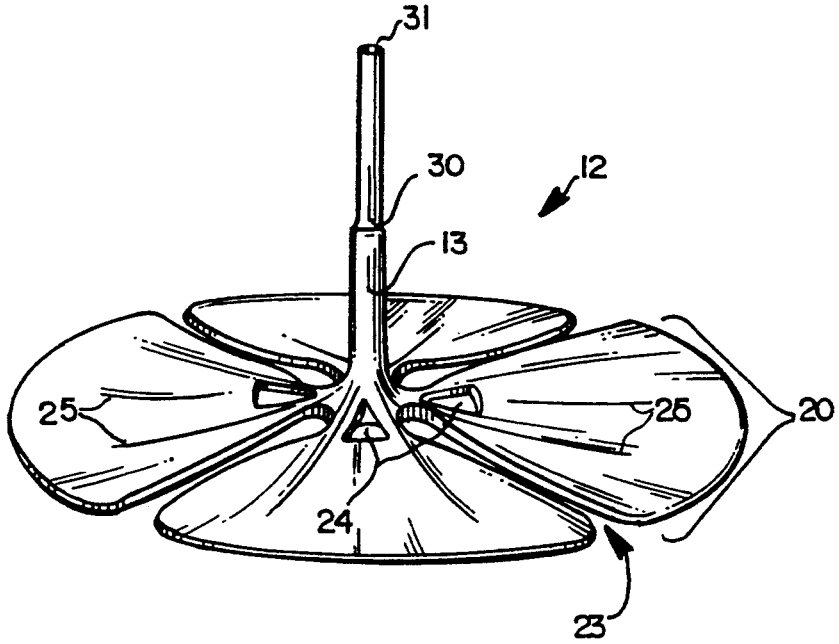
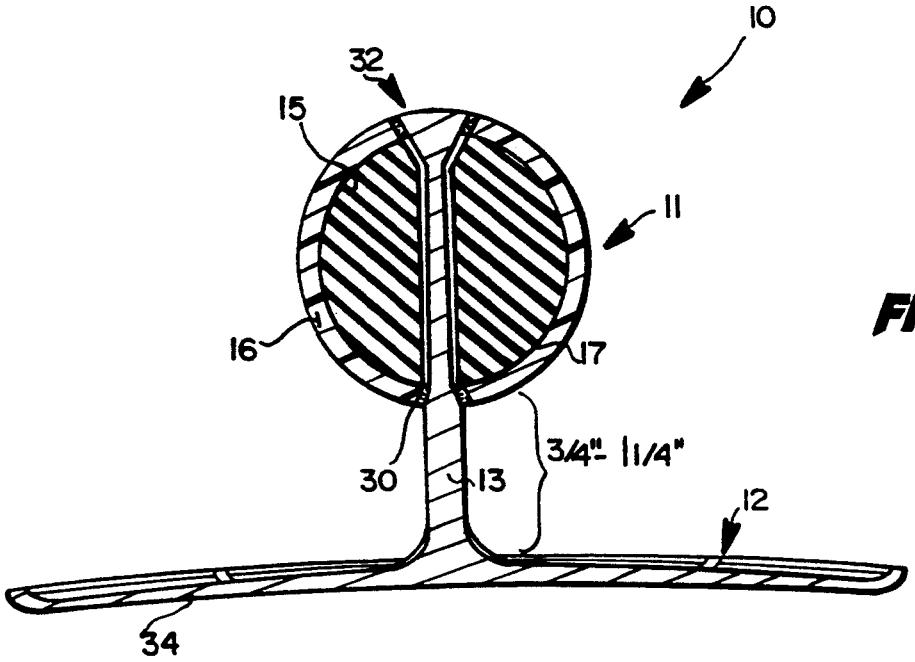
FIG. 4

GOLF BALL PRACTICE DEVICE

BACKGROUND AND SUMMARY OF THE INVENTION

It has long been considered desirable to provide a golf practice device that allows a golfer to practice his/her strokes, as well as accuracy, while retaining the impact feel and controlled flight pattern of a regulation golf ball, yet do so in a more restricted space than necessary if a real golf ball is used. The prior art proposals for accomplishing this objective have not been entirely successful. If a ball is attached to a string or cable type element, there is no true flight given to the ball when impacted by a golf club, the ball typically having a jerky flight, little stability, and no true trajectory, while wrapping of the string or cable around various elements may occur. The prior proposals for accomplishing tile goals of the invention do not provide sufficient air resistance, or there is an inherently unsafe attachment between the component parts. Others require the ball to be teed up with a conventional tee, which can only be used on dirt or grass, i.e., not asphalt, brick, wood, etc.

According to the present invention, a golf ball practice device is provided that achieves the objectives of allowing a golfer to practice his or her golf stroke in a realistic mariner while the device has a true and accurate trajectory, at least until the very end of flight. However, the device according to the invention has significant air resistance. It will travel only a fraction of the distance of a conventional golf ball, typically a maximum of about 100 feet, and more typically about 30–80 feet, or less. The practice device according to the present invention may be used on virtually any surface, automatically teeing up the ball a suitable height on hard surfaces as well as a dirt or lawn surface. The device according to the invention is also simple and relatively inexpensive to construct, and may be manufactured utilizing already existing regulation golf balls, or may be specially manufactured in a unitary manner.

According to one aspect of the present invention, a golf ball practice device is also comprising the following elements: A ball having substantially the same size, shape, appearance as a regulation golf ball. A substantially disc shaped drag element, having drag inducing openings and surface manifestations provided therein. A shaft connecting the drag element and ball so that they are integral, the substantially disc shaped drag element extending substantially perpendicular to the shaft, and the shaft extending radially with respect to the ball. And, the shaft has a length between the drag element and ball sufficient to elevate the ball about 1–1.5 inches off of a surface on which the drag element is placed.

The shaft typically has a length between the drag element and the ball or about ¾ of an inch to an inch and ¼. The shaft and the drag element: typically comprise a one piece molded resilient plastic or rubber structure, the one-piece molded structure connected to the ball by passing through a through extending diametrical opening in the ball, and by ultrasonic welding or other permanent attachment of the ball opposite ends to the shaft. The drag element normally comprises a plurality of radial segments with air flow through spaces between the segments, allowing the segments to be swept back as the device moves through the air when the ball is impacted by a golf club. The drag element preferably has a substantially fiat face on the "bottom" thereof, that is the surface opposite the shaft. The radial segment also may have generally radially extending slits or ridges.

The ball preferably is an actual regulation golf ball, or closely simulating one, having a rubber compound core, and exteriorly dimpled plastic shell about an ⅛ of an inch thick, a circumference of about 5 ¼ inches, and a weight of roughly 45 grams. The device is very simple and preferably consists of the drag element, shaft, and ball. The drag element is constructed to allow a maximum flight of the device when the ball is impacted by a golf club swung by a human of about 100 feet (preferably about 30–80). The drag element, shaft and ball may alternatively be constructed of a unitary molded structure.

According to another aspect of the present invention, a golf ball practice device is provided comprising: A ball having substantially the same size, shape, and appearance as a regulation golf ball. A substantially disc shaped drag element, having drag inducing openings and surface manifestations provided therein. A shaft connecting the drag element and ball so that they are integral, the substantially disc shaped drag element extending substantially perpendicular to the shaft, and the shaft extending radially with respect to the ball. And, wherein the shaft and the drag element comprising a one-piece molded resilient plastic or rubber structure.

According to yet another aspect of the present invention, a golf ball practice is comprising and consisting essentially of the following elements: A ball having substantially the same size, appearance, and composition as a regulation golf ball. A substantially disc shaped drag element, having drag inducing openings and surface manifestations provided therein. A shaft connecting the drag element and ball so that they are integral, the substantially disc shaped drag element extending substantially perpendicular to the shaft, and the shaft extending radially with respect to the ball. And the ball having a rubber compound core, an exteriorly dimpled plastic shell about ⅛ inch thick, a circumference of about 5.25 inches, and a weight of roughly 45 gm.

It is the primary object of the present invention to provide a simple, yet effective, golf ball practice device which has the appearance, impact feel, and controlled flight pattern of regulation golf balls, but a much reduced flight distance. This an other objects of the invention will become from an inspection of tile detailed description of tile invention and from the appended claims.

BRIEF DESCRIPTION OF THE DRAWINGS

FIG. 3 is a perspective view of only the drag element and shaft of an exemplary golf practice device according to the invention;

FIG. 4 is a side view, partly in cross section and partly in elevation, of an exemplary golf practice device according to the invention utilizing the shaft and drag element of FIG. 3.

DETAILED DESCRIPTION OF THE DRAWINGS

Figure 1:
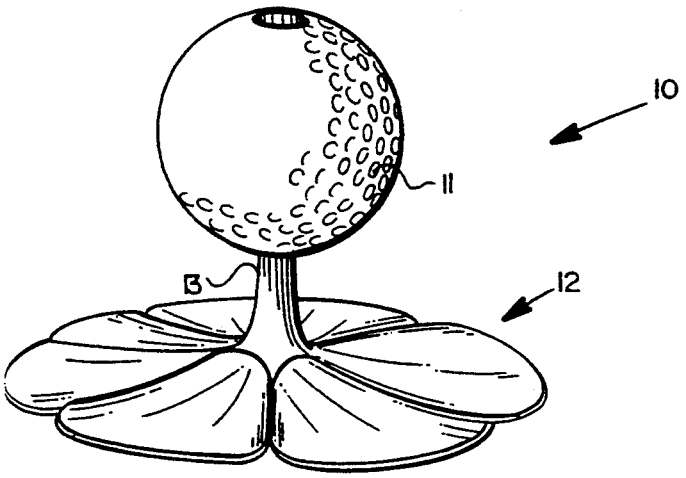
FIG. 1 is a perspective view of an exemplary golf practice device according to the present invention.

An exemplary golf practice device according to tile present invention is shown generally by reference numeral 10 in FIG. 1. The device 10 has as the major components thereof a ball 11, a drag element substantially shaped like a disk, shown generally by reference numeral 12, and a shaft 13.

The ball 11 has substantially the same size (e.g., a circumference of about 5.25 inches), shape (spherical), and appearance (a dimpled exterior surface), as a regulation golf ball. In fact, according to one preferred embodiment of tile invention, it also has the same composition. For example, for the embodiment illustrated, the golf ball 11 shown in FIG. 4, the core 15 is of a rubber compound with an exteriorly dimpled outer plastic shell 16 having a thickness of about ⅛ of an inch, the ball 11 having a weight of roughly 45 grams, and a circumference of about 5.25 inches. In the embodiment illustrated in FIG. 4, the ball 11 has a through extending diametrical bore or opening 17, which may be formed by actually drilling a conventional regulation golf ball.

Figure 2:
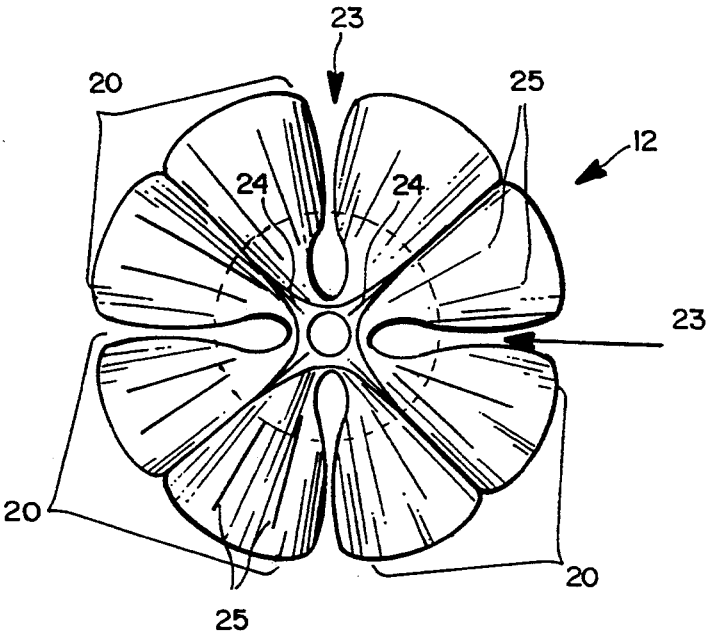
FIG. 2 is a top plan view of the device of FIG. 1 with the ball shown in dotted line.

The substantially disk shaped drag element 12 is constructed to have air flow openings therethrough so that it provides substantial drag as the device 10) moves through the air. One way that this may be accomplished is to form the device 12 into a plurality of radial segments, e.g., four radial segments 20 as illustrated in FIGS. 1–3, although any number of segments may be provided. Preferably, the disk shaped element 12 and the shaft 13 are of a unitary construction, being a one piece molding from rubber or a resilient plastic which can absorb the force of a golf club if it inadvertently strikes the shaft 13 or disk 12, and with tile disk 12 having a construction such that the radial segments 20 thereof are swept back (as seen at position 22 in FIG. 5) during flight. However, the element 12 and shaft 13 may also be two different pieces.

Radially extending air flow through spacings 23 may be provided between segments 20, supported by ridges 24 (see FIGS. 2 and 3). In addition other drag inducing openings and/or surface manifestations may be provided associated with the drag element 12, such as the radially extending slits or ridges 25 which typically—if slits—do not go all the way to the periphery of the segments 20 with which they are associated, or—if ridges or like surface manifestations—may extend varying distances from the body of disk 12.

While the device 10 can be of a one piece unitary construction, with elements 11 through 13 unitary molded from tile same material, according to one preferred embodiment of tile invention, the unitary element 12, 13 is fastened to a regulation golf ball 11 having the diametrical bore 17 therein, in this embodiment (FIGS. 3 & 4), preferably the shaft 13 provided with a tapered, generally conical shoulder 30 which provides a stop for the lower part of the ball 11, being of larger diameter than the bore 17, while the top extremity 31 of the shaft 13 is spaced from the shoulder 30 a greater distance than the length of the bore 17 (diameter of the ball 11). The shaft 13 is then ultrasonically welded or otherwise permanently attached (e.g. by gluing) to the shell 16. The end 32 of tile shaft 11 is shown in FIG. 4 deformed as a result of the ultrasonic welding, to permanently attach it to the shell 16. Ultrasonic welding or the like may also be provided at the area where the shoulder 30 engages the shell 16.

Preferably the disk shaped drag element 12 has a substantially flat bottom surface 34 as seen in FIG. 4. This allows the device 10 to be placed on virtually any surface whether lawn, dirt, concrete, asphalt, brick, wood, etc.

Figure 5:
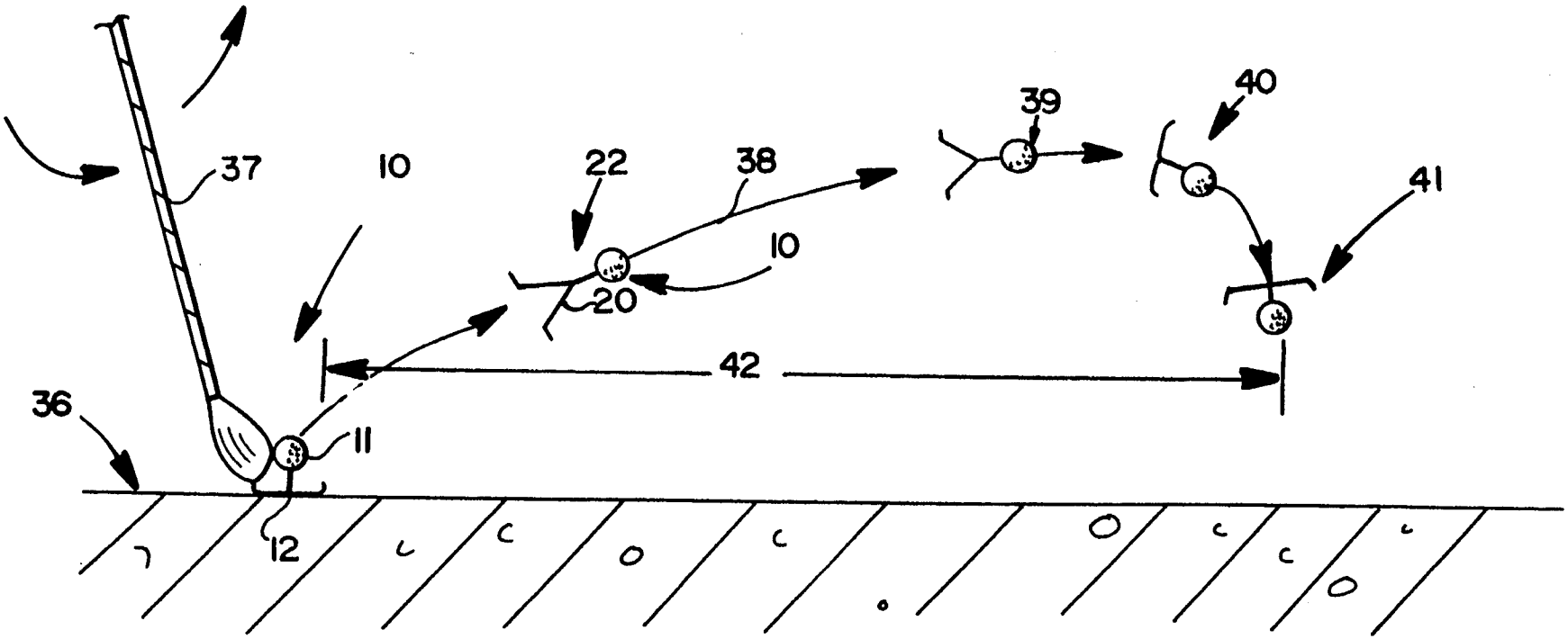
FIG. 5 is a schematic view illustrating use of the golf practice device according to the invention, with a simulated flight trajectory.

FIG. 5 schematically illustrates an exemplary manner of utilization of the device 10 according to the invention. As shown at the left-handed side of FIG. 5, the device 10 is placed with the substantially fiat surface 24 of element 12 thereof on a ground surface 36, such as a driveway, street, or field. Golf ball 11 is impacted by the human golfer swinging the golf club 37 in his or her normal stroke. This causes the device 10 to assume the trajectory 38, initially the segments 20 being swept back by the force of the device 10 passing through the air as illustrated at position 22, the segments 20 ultimately moving back toward and to their normal position substantially perpendicular the shaft 13 as indicated at position 39 and then ultimately position 40, in FIG. 5. Once the device 10 reaches the position 40, the device then falls softly almost directly to earth as illustrated at position 41. The total trajectory distance 42 is typically about 100 feet or less, preferably about 30–80 feet. Because of the soft nature of the end of the flight, in actuality another person can catch the device 10 before it hits the ground, and then can place it on the ground and hit it back to the original golfer, or otherwise make a game or competition out of utilization of the device 10. Because of its construction when the device 10 impacts the ground it will bounce little, and not travel far.

It will thus be seen that according to the present invention, a simple, yet very effective golf practice device has been provided. The practice device according to the present invention is used by golfers in practicing their strokes completely simulating a regulation golf ball and having accuracy and trajectory, but a much reduced flight distance. While the invention has been herein shown in describing what is presently conceived to be the most practical and preferred embodiment, it is to be apparent to those of ordinary skill in the art that many modifications may be made therein within the spirit and scope of the invention, which scope is to be accorded the broadest interpretation of the appended claims so as to encompass all equivalent structures and devices.

What is claimed is:

1. A golf ball practice device, comprising:

a ball having substantially the same size, shape, and appearance as a regulation golf ball;

a substantially disc shaped drag element, having drag inducing openings and surface manifestations provided therein;

a shaft connecting said drag element and ball so that they are integral;

said substantially disc shaped drag element extending substantially perpendicular to said shaft, and said shaft extending radially with respect to said ball; and said shaft having a length between said drag element and ball sufficient to elevate said ball about 1–1.5 inches off of a surface on which said drag element is placed.

2. A device as recited in claim 1 wherein said shaft has a length between said drag element and ball of about 0.75–1.25 inches.

3. A device as recited in claim 1 wherein said shaft and said drag element comprise a one-piece molded resilient plastic or rubber structure.

4. A device as recited in claim 3 wherein said one-piece molded structure is connected to said ball by passing through a through extending diametrical opening in said ball, and by permanently attaching said shaft to opposite ends of said ball.

5. A device as recited in claim 1 wherein said drag element comprises a plurality of radial segments, with air flow-through spaces between said segments, allowing said segments to be swept back as said device moves through the air when said ball is impacted by a golf club.

6. A device as recited in claim 5 further comprising a plurality of generally radial slits or ridges formed in or on said radial segments.

7. A device as recited in claim 1 wherein said ball has a rubber compound core, an exteriorly dimpled plastic shell about ⅛ inch thick, a circumference of about 5.25 inches, and a weight of roughly 45 gm.

8. A device as recited in claim 1 consisting of said drag element, shaft, and ball.

9. A device as recited in claim 1 wherein said drag element, shaft, and ball comprise a unitary molded structure.

10. A device as recited in claim 1 wherein said drag element is constructed to allow a maximum flight of said device when said ball is impacted by a golf club swung by a human of about 100 feet.

11. A device as recited in claim 1 wherein said drag element has a substantially fiat surface opposite said shaft.

12. A golf ball practice device, comprising:

a ball having substantially the same size, shape, and appearance as a regulation golf ball:

a substantially disc shaped drag element, having drag inducing openings and surface manifestations provided therein:

a shaft connecting said drag element and ball so that they are integral:

said substantially disc shaped drag element extending substantially perpendicular to said shaft, and said shaft extending radially with respect to said ball: and wherein said shaft and said drag element comprise a one-piece molded resilient plastic or rubber structure.

13. A device as recited in claim 12 wherein said shaft has a length between said drag element and ball of about 0.75–1.25 inches.

14. A device as recited in claim 12 wherein said one-piece molded structure is connected to said ball by passing through a through extending diametrical opening in said ball, and by permanent attachment of said shaft to opposite ends of said ball.

15. A device as recited in claim 12 wherein said drag element comprises a plurality of radial segments, with air flow-through spaces between said segments, and further comprising a plurality of generally radial slits formed in or on said radial segments.

16. A device as recited in claim 12 wherein said ball has a rubber compound core, an exteriorly dimpled plastic shell about ⅛ inch thick, a circumference of about 5.25 inches, and a weight of roughly 45 gm.

17. A golf ball practice device, consisting essentially of:

a ball having substantially the same size, appearance, and composition as a regulation golf ball;

a substantially disc shaped drag element, having drag inducing openings and surface manifestations provided therein;

a shaft connecting said drag element and ball so that they are integral;

said substantially disc shaped drag element extending substantially perpendicular to said shaft, and said shaft extending radially with respect to said ball; and wherein said ball has a rubber compound core, an exteriorly dimpled plastic shell about ⅛ inch thick, a circumference of about 5.25 inches, and a weight of roughly 45 gm.

18. A device as recited in claim 17 wherein said drag element is constructed to allow a maximum flight of said device when said ball is impacted by a golf club swung by a human of about 100 feet.

19. A device as recited in claim 17 wherein said drag element has a substantially fiat surface opposite said shaft.

20. A device as recited in claim 19 wherein said substantially disc-shaped drag element comprises a plurality of radial segments, with air flow-through spaces between said segments.

* * * * *